US006781101B1

(12) United States Patent
Hoese et al.

(10) Patent No.: US 6,781,101 B1
(45) Date of Patent: Aug. 24, 2004

(54) RECONFIGURABLE MICROWAVE PACKAGE FOR COOKING AND CRISPING FOOD PRODUCTS

(75) Inventors: Thomas C. Hoese, Hopkins, MN (US); Essam Wahbah, Minneapolis, MN (US); Peeyush Maheshwari, Plymouth, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 10/358,988

(22) Filed: Feb. 5, 2003

(51) Int. Cl.[7] ..... H05B 6/80
(52) U.S. Cl. ..... 219/730; 219/725; 229/903
(58) Field of Search ..... 229/901–906; 219/730, 725, 735

(56) References Cited

U.S. PATENT DOCUMENTS

| | | | | |
|---|---|---|---|---|
| 4,894,503 | A | 1/1990 | Wendt | 219/10.55 |
| 4,904,836 | A | 2/1990 | Turpin et al. | 219/10.55 |
| 4,970,360 | A | 11/1990 | Pesheck et al. | 219/10.55 |
| 5,006,684 | A | 4/1991 | Wendt et al. | 219/10.55 |
| 5,019,681 | A | 5/1991 | Lorence et al. | 219/10.55 |
| 5,034,234 | A | 7/1991 | Andreas et al. | 426/107 |
| 5,041,295 | A | 8/1991 | Perry et al. | 426/107 |
| 5,049,710 | A | 9/1991 | Prosise et al. | 219/10.55 |
| 5,096,723 | A | 3/1992 | Turpin | 426/107 |
| 5,106,635 | A | 4/1992 | McCutchan et al. | 426/107 |
| 5,170,025 | A | 12/1992 | Perry | 219/10.55 |
| 5,173,580 | A | 12/1992 | Levin et al. | 219/10.55 |
| 5,334,820 | A | 8/1994 | Risch et al. | 219/730 |
| 6,137,099 | A | 10/2000 | Hamblin | 219/730 |

*Primary Examiner*—Thor Campbell
(74) *Attorney, Agent, or Firm*—Kagan Binder, PLLC

(57) ABSTRACT

A reconfigurable microwave packaging container is provided for containing, heating, and crisping at least one surface of at least one food product. The container includes a reconfigurable first panel having a flap that is at least partially separable from the container, and at least a portion of the flap includes a microwave susceptor material for absorbing microwave energy to transfer to at least one food product surface. The container also includes a second panel spaced from the first panel by a first distance to accommodate at least one food product between the first and second panels. The flap of the first panel is reconfigurable to be spaced at a second distance from the second panel, wherein the second distance is smaller than the first distance.

28 Claims, 5 Drawing Sheets

RECONFIGURABLE MICROWAVE PACKAGE FOR COOKING AND CRISPING FOOD PRODUCTS

TECHNICAL FIELD

The present invention relates to a packaging and cooking system for microwave cooking of one or more food items. In particular, the invention is directed to a packaging system for microwave cooking of food items that provides relatively crisp outer surfaces, while adequately heating and cooking the interior portion of the food items.

BACKGROUND OF THE INVENTION

Microwave ovens provide to consumers a quick and convenient option for cooking and heating food products that typically requires less time and effort than that involved when heating the same food products in a conventional oven. However, heating foods in a microwave oven involves different considerations than heating foods in a conventional oven. In particular, conventional ovens operate by maintaining a relatively constant and homogeneous high temperature environment in which food products are placed for cooking and/or warming. The conventional oven heat initially warms the outer surfaces of the food product, and then this heat gradually progresses toward the center of the food by conduction or other heat transfer mechanisms. Because the outer surfaces of the food product are warmed first, moisture is driven away from the outer surface of the food product, thereby providing an outer surface that is more likely to be crisp than to be soggy or soft.

In contrast, microwave cooking or heating involves the use of electromagnetic radiation at a high intensity and high frequency. The radiation is transmitted to the food product so that the radiation or microwaves penetrate a substantial distance into the interior portion of the food product. Heating of the food product, and particularly the interior portion of the food product, occurs as the food absorbs this electromagnetic energy. Thus, the interior portion of the food product is typically heated much more quickly than the exterior surface, which causes the moisture to be driven from the center of the food product to the surface. In addition, microwave energy often causes the interior portion of the food to reach its desired serving temperature while the exterior surface is only partially warmed. This temperature of the exterior surface is typically not high enough or is not maintained at a high temperature for a long enough time to drive sufficient moisture away from the surface. This will typically result in a product that is soggy on the outside, but cooked and warmed on the inside. While it is possible to continue to subject the food product to additional microwave energy in an effort to drive excess moisture away from its outer surface, such additional heating of the product can increase the interior temperature of the food product so much that it detrimentally affects the quality of the food product (i.e., the interior portion is overcooked) and/or makes the product too hot for the consumer to eat.

Methods and devices have been developed to attempt to reduce the moisture content of the outer surfaces of microwaved food products to a sufficiently low level that the product surfaces are perceived as crisp to the consumer. "Crispness", as the term is used herein, refers primarily to the taste and touch sensation characteristics experienced by the consumer who is holding and eating a particular food product. In particular, a product surface that is crisp may be described as relatively brittle and dry to the touch, as opposed to soggy product surfaces that are relatively soft and moist to the touch. Many previously developed methods and devices include the use of a susceptor material that is in close proximity to or in direct contact with a food product surface for the purpose of heating that surface to a higher temperature so that it can become more crisp. These susceptors typically include a sheet or film having a conductive coating, such as a metallized film, which absorbs microwave energy during exposure to microwave fields. As described in U.S. Pat. No. 5,041,295 (Perry et al.), commonly owned by the assignee of the present invention, the perception of crispness may be achieved by providing a food product that is generally crisp on only one surface, as long as the other surfaces of the food product are not particularly soggy or mushy. Perry et al. achieves this crispness on one food product surface through the use of a susceptor located in close proximity to or in direct contact with one surface of the food product.

Other examples of attempts to achieve crisping involve using flexible wrapping material including a microwave susceptor layer or material. The wrapping material is wrapped completely around a food product to contact all or most of the outer surface area of the product. Unfortunately, these methods often prevent or inhibit the movement of sufficient moisture from the exterior surfaces of the food product, which can thereby cause the product to be soggy. In addition, when a package is provided with multiple food products that are relatively small (e.g., fish sticks or pizza rolls), it can be cumbersome and time-consuming to place each food product into its own flexible wrapping material, and then remove each product from its wrapping material after cooking in the microwave.

A further issue with these systems using flexible wrapping material is that the material is typically provided in a kit that includes multiple components with which the user must perform multiple operations to cook the food product or products. For example, a filled pizza dough product can be provided in an outer shipping package that includes the filled dough product within a plastic wrapper and a separate cooking sleeve made of a flexible wrapping material. To cook the product, the consumer would first open the outer shipping package to access the food product and the cooking sleeve. The consumer would then remove the food product from the shipping package and its plastic wrapper and slip the cooking sleeve over the food product. The consumer would then place the food product and sleeve in the microwave on a separate plate or napkin to keep the food product from directly contacting the microwave oven surfaces. After the food product is cooked, the consumer must remove the sleeve from the product and would then typically place the product on some other serving piece for consumption of the product. This process creates several disposable packaging and cooking items, and requires the consumer to follow several steps for proper cooking of the food product. Further, as explained above, these cooking sleeves often do not produce the desired levels of crispness since excess moisture is trapped between the sleeve and the outer surface of the food product, which typically causes the outer surface of the food product to become soggy.

Another factor that can make consistent crisping of microwaved food products difficult is the variability in the size of individual food products. Although food product manufacturers typically have specifications for the volume of various food components that go into each individual product, the tolerances on the exact size and shape of the finished products can be relatively loose to accommodate for environmental variability, raw material differences, and other factors. For example, changes in the operating conditions of the production machinery and even slight differences in the physical properties of the food materials can result in products that are slightly different from each other in size and shape. In some cases, the different sizes and shapes of various products that are cooked in a microwave at the same time can result in different heating and crisping of the products. That is, some of the food products could be at a desired temperature and crispness, while other products are either too hot or cold, and may also be more or less crisp than desired.

It is therefore desirable to provide a packaging and cooking system that is easy and convenient for the consumer and that can provide food products that have consistently crisp outer surfaces and interior surfaces that are heated to a uniform desired serving and consuming temperature. It is further desirable to provide such a system that minimizes packaging waste and minimizes the number of steps that need to be executed to produce a product having the desired temperature and crispness.

SUMMARY OF THE INVENTION

In one aspect of this invention, a reconfigurable microwave packaging container is provided for containing, heating, and crisping at least one surface of at least one food product. The container includes a reconfigurable first panel having a flap that is at least partially separable from the container, and at least a portion of the flap includes a microwave susceptor material for absorbing microwave energy to transfer to at least one food product surface. The container also includes a second panel spaced from the first panel by a first distance to accommodate at least one food product between the first and second panels. The flap of the first panel is reconfigurable to be spaced at a second distance from the second panel, wherein the second distance is smaller than the first distance.

The flap of the container may include at least one fold line to facilitate the reconfiguration of the flap. At least one part of the flap may also be reconfigurable to contact an outside surface of at least one food product. The container may also include at least one gap between the flap and one of the container panels to allow steam to escape from the container during the microwave cooking process. The container may include at least one food product that is microwavable to achieve an outer food product surface that is crisper than an interior portion of the food product, where this food product may be a filled dough product, such a pizza roll.

The present invention also includes a method of containing, heating, and crisping at least one food product. This method includes the steps of providing a reconfigurable container having a first panel, a second panel spaced from the first panel, and at least one food product positioned between the first and second panels. The first panel includes a microwave susceptor material and a flap having a fold line. The method further includes partially separating the flap from the container, folding the flap along the fold line, and pressing the flap toward the second panel of the container until the microwave susceptor material of the flap contacts the at least one food product within the container. Microwave energy is then applied to the container so that the food products are heated by a predetermined amount.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

The present invention is directed to microwave packaging that provides the functions of being a shipping container, cooking and crisping container, and serving container for food products. The package is capable of providing all of these functions through the use of a reconfigurable design that is easy and efficient for the consumer to use. To accomplish this, a flexible material, such as paper, is formed into a package that is subsequently filled with at least one food product before the package is sealed. At least one of the interior surfaces of the package includes a microwave susceptor that will come in contact with at least one food surface to allow for crisping of the outside surface of the food while cooking and heating the inside of the food to an appropriate temperature. In one preferred embodiment of the invention, to cook and crisp the food being held in the container, a package flap including a microwave susceptor is partially separated or detached from the package and reconfigured so that it either touches or is in close proximity to the food products, thereby facilitating the crisping of the outside of the food products while adequately cooking and heating the inside of those same food products. The same package may then be used for serving the food products for consumption.

Figure 1:
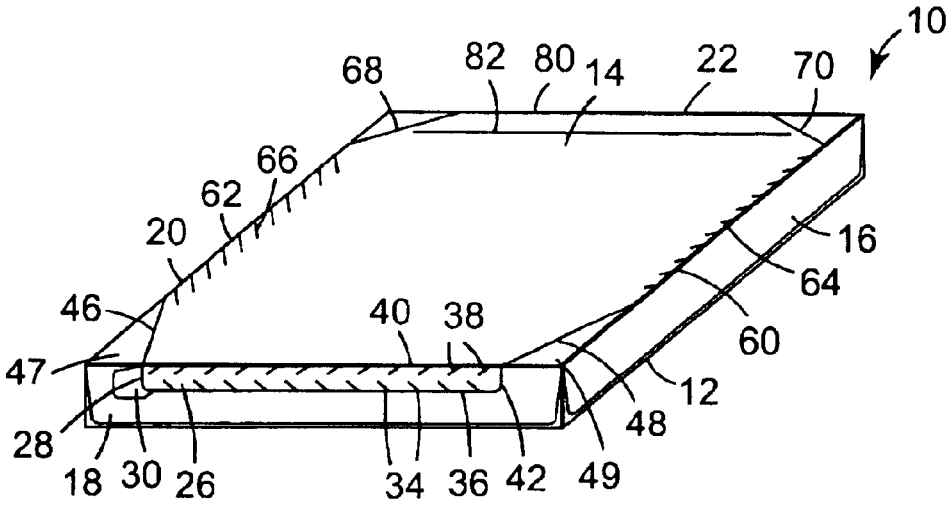
FIG. 1 is a perspective view of a closed packaging container in accordance with the present invention, wherein the packaging container is in a condition that it could contain at least one food product for heating, crisping, and serving.

Referring now to the Figures, wherein the components are labeled with like numerals throughout the several Figures, and initially to FIG. 1, one preferred configuration of a food package 10 is illustrated. As shown, package 10 includes a bottom planar panel 12 and a top planar panel 14 that is spaced from the bottom panel 12 by a distance that corresponds with the height of opposite side panels 16, 20, a front panel 18, and an opposite back panel 22. In this case, the package 10 is generally rectangular so that the length of the side panel 16 is equal to the length of the opposite side panel 20, and the front panel 18 has the same length as that of the opposite back panel 22. Although this is one embodiment of a package contemplated by the present invention, other package configurations and shapes are contemplated to be used in connection with the present invention, such as packages including four side panels of the same length (i.e., a square shaped box), packages with more or less than four sides, boxes that have curvilinear rather than planar surfaces, and other shapes and sizes that can contain various sizes and shapes of food products. Further, although the present description refers to the various panels and surfaces as having directional and orientational aspects such as bottom, top, sides, and the like, these terms are only intended to be for purposes of describing the relative relationship between the panels and is not intended to limit the orientation of any particular package. For example, the described package 10 could either be placed in a microwave with its bottom panel 12 positioned adjacent the bottom of the microwave, or the package could be oriented so that the bottom panel 12 is facing one of the sides or the top of the microwave, depending on the desired package performance.

The package 10 is preferably made of a paper material that is both flexible enough to allow for the necessary folding and reconfiguring of the package before and after cooking, and also rigid enough to maintain the structural integrity of the package, such as a medium weight paper or paperboard substrate. In addition, the paper material should be sufficiently strong to support one or more layers or coatings of susceptor material on at least one internal package surface. Examples of appropriate papers for use in the present invention include various types of folding carton stock or paperboard materials, such as any of a wide variety of those commercially available from the Georgia-Pacific Corporation of Atlanta, Ga., under the name SBS Naheola Folding Carton Stock products, for example. The paperboard material may be coated with a material on one or both sides to prevent or minimize absorption of grease or other liquids into the paperboard during the shipping, storage, and heating processes. If the paperboard is provided with such a coating, the coating material is preferably one that exhibits low volatile emissions in microwave environments. The paperboard material is also preferably in the range of 0.012 inch (0.030 cm) thick to 0.025 (0.064 cm) thick, although the paperboard material could be thinner or thicker than this range, depending on the configuration of the container, the product to be held within the container, and the like.

Figure 2:
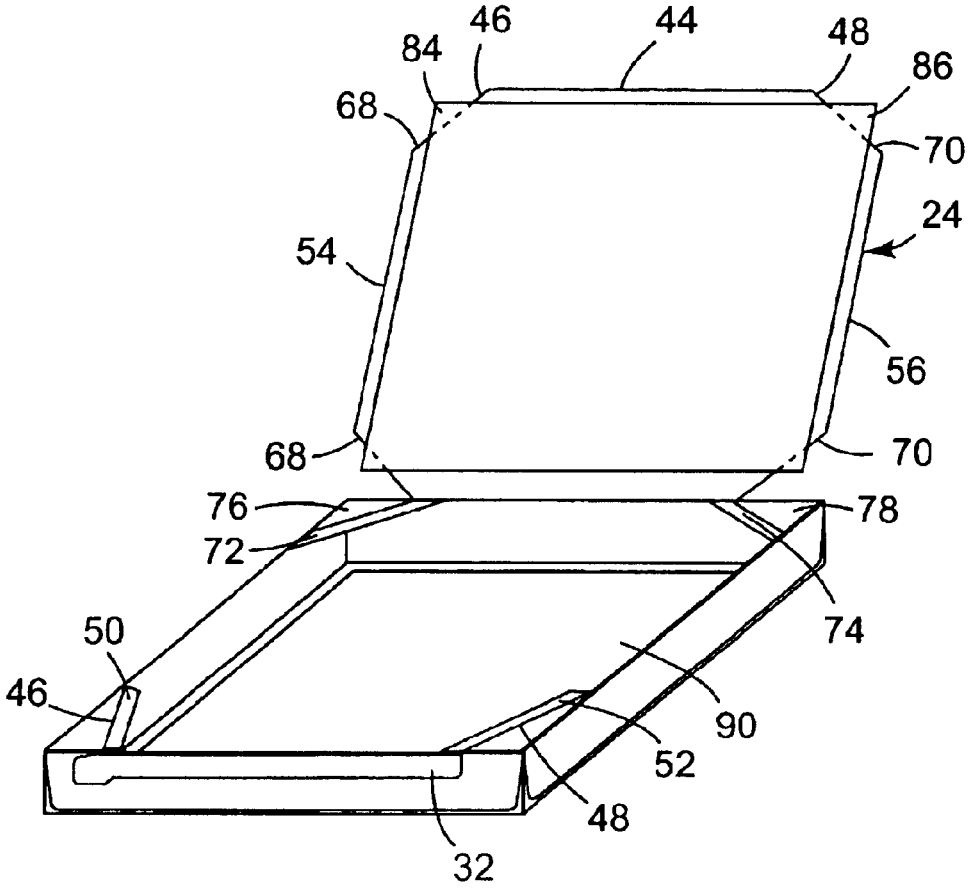
FIG. 2 is a perspective view of the packaging container of FIG. 1 with a reconfigurable flap portion retracted from the other portions of the packaging container.

Top panel 14 is preferably a generally planar surface having a number of lines of weakening, perforations, and/or fold lines that are provided to allow a flap 24 to be pulled partially away or separated from the remainder of the package, as shown in FIG. 2. As shown, the flap 24 is separable from the panels 16, 18, 20, while remaining attached at the intersection of the top panel 14 and the back panel 22. To facilitate this partial separation of the flap 24, panel 14 includes a number of different paper tearing and/or cutting features, where FIGS. 1 and 2 are intended to illustrate only one representative combination of these features. In other words, either these or other tearing and cutting features may be used in the manner described below or used in a different combination to achieve the desired results of the present invention. As shown specifically in FIG. 1, a tear strip 26 is located along the front panel 18, which tear strip 26 includes a first end 28 that is adjacent to an opening or gap 30. As constructed, the front panel 18 having the tear strip 26 is actually an outer flap that is adhered below the tear strip 26 to an inner box portion 32 that can be seen in FIG. 2 (after removal of the tear strip 26). In this way, when the tear strip 26 is removed from the front panel 18, as described below, the package 10 will still have four complete sides to make up the interior of the package. The portion of inner box portion 32 that is behind the tear strip 26 and the remaining portion of front panel 18 will then make up the front face of the package 10.

Front panel 18 and tear strip 26 further comprise a first series of angled cut or score lines 34 and a corresponding first series of parallel, linear perforations 36, both extending along the lower edge of tear strip 26. A second series of parallel, linear perforations 40 extends generally along the interface or fold line between front panel 18 and top panel 14, and a corresponding second series of angled cut or score lines 38 extends generally from this series of perforations 40 and toward the other series of perforations 40 of the tear strip 26. These angled score lines 34, 36 and perforations 36, 40 are preferably small thin cuts that extend through the entire thickness of the paper material; however, these angled score lines and perforations may instead be weakened areas that extend only partially through the thickness of the paper. In either case, to begin the process of opening the package 10, a finger or other object is inserted partially into the opening 30 between the first end 28 of the tear strip 26 and the inner box portion 32. The first end of tear strip 26 is then grasped and pulled away from front panel and toward a second end 42 of tear strip 26 along the score lines 36, 38 and the perforations 36, 40. These score lines and perforations facilitate clean removal of the strip 26 along its top and bottom edges as it tears away from the front panel 18.

After the strip 26 is removed, a free front edge 44 of top panel 14 is exposed, which is also the front edge 44 of the portion of top panel 14 that will become the flap 24. As shown, front edge 44 extends along only a portion of the length of the top panel 14, thereby leaving two portions (described below) where the front panel 18 remains attached to the top panel 14, one on each side of the flap 24. The front edge 44 is thus shorter than the overall length of the front panel 18. In particular, two angled flap edges 46, 48 extend at an angle from opposite ends of front edge 44 and toward the side panels 20, 16, respectively. These angled edges 46, 48 are formed by a technique that may be referred to as double-cutting. "Double cutting", as referred to herein, is a cutting method that uses one knife to cut a first score line through approximately half, but less than the entire thickness of the paper, and a second knife to cut a second score line from the opposite side of the paper. The second score line is spaced from the first score line and is also cut through approximately half, but less than the entire thickness of the paper. This cutting technique is designed to facilitate the paper separating or delaminating through its thickness (i.e., horizontally, in this embodiment) in the area between the two score lines. In this embodiment, angled edges 46, 48 are score lines that are cut from the top of the paper and are visible in FIG. 1 and the score lines that are cut from the opposite side of the paper are on the inside of the package 10 and therefore are not visible in FIG. 1.

To begin pulling the flap 24 away from the top panel 14 to open the package, the front edge 44 can be grasped and pulled toward the back panel 22. Referring again to FIG. 2, as the portion of the flap 24 along the angled edges 46, 48 is pulled away, the paper essentially tears horizontally through its thickness in the areas between the first and second score lines on each side of the box, thereby leaving a thin portion of the flap 24 between the two score lines on both the flap and the top panel 14. The remaining portions 50, 52 that extend beyond the angled edges 46, 48 on the top panel 14 (shown as extensions beyond triangle-shaped portions 47, 49 in the illustration) are thus thinner than the triangle-shaped portions of the top panel 14. Because these portions 50, 52 can serve the purpose of helping to hold the flap 24 within the package during cooking, as described below, this double-cutting technique is preferable for these edges. In addition, this cutting technique is generally reliable and provides an easy separation of that portion of the package. It is understood, however, that many different separation and cutting techniques may be used for these edges. It is further understood that the tear strip described above may instead extend along more or less of the front panel 18 of the package than that shown in the figures. For example, the tear strip may extend along the entire length of the front panel 18, thereby eliminating the triangle-shaped portions 47, 49 (i.e., the front edge 44 of flap 24 would extend along the entire length of the front panel 18).

The flap 24 further includes opposite side edges 54, 56 that extend from the angled edges 46, 48 toward the back panel 22. To form these side edges 54, 56, a series of perforations or score lines 60 that are spaced from each other are cut along the fold line between the side panel 16 and the top panel 14, and a series of perforations or score lines 62 that are spaced from each other are cut along the fold line between the side panel 20 and the top panel 14. The perforations 60, 62 preferably, but not necessarily, extend through the entire thickness of the paper and are spaced close enough to each other to facilitate a clean separation between the top and side panels without tearing the panels or flap. To further facilitate this clean separation, the top panel is preferably further provided with a first series of angled score lines or perforations 64 that extend generally from the perforations 60 toward the interior area of the top panel 14. Similarly, a second series of angled score lines 66 extend generally from the perforations 62 toward the interior area of the top panel 14. The number of these angled perforations 64, 66 may correspond directly to the number of perforations 60, 62, respectively, and may extend from one of the ends of each of the perforations 60, 62, or there may be more or less perforations 60, 62 than angled score lines 64, 66.

The side edges 54, 56 may extend in a relatively straight line along the top panel 14 all the way to the back panel 22 (i.e., no angled edges near the back panel 22), or may instead include two angled flap edges 68, 70 that extend at an angle from the edges 54, 56, respectively, toward the back panel 22. These angled flap edges 68, 70 may mirror those angled flap edges 46, 48 near the front edge of the flap 24, or may be differently configured. In this embodiment, the angled edges 68, 70 extend to a fold line 80 that defines the intersection of the top panel 14 and the back panel 22. As with the angled edges 46, 48 near the front of the box, the angled edges 68, 70 may be formed with a double-cutting technique, which uses one knife to cut a first score line through approximately half, but less than the entire thickness of the paper, and a second knife to cut a second score line from the opposite side of the paper that is spaced from the first score line and also cuts through approximately half, but less than the entire thickness of the paper. In this embodiment, angled edges 68, 70 are score lines that are cut from the top of the paper and are visible in FIG. 1 and the score lines that are cut from the opposite side of the paper are on the inside of the package 10 and therefore are not visible in FIG. 1.

As with the double-cut edges 46, 48, as the portion of the flap 24 along the angled edges 68, 70 is pulled toward the back panel 22 to open the package 10, the paper of the top panel 14 essentially tears horizontally through its thickness in the areas between the first and second score lines one each side of the box, thereby leaving a thin portion of the flap 24 that was between the two score lines on both the flap and the top panel 14. The remaining portions 72, 74 that extend beyond the angled edges 68, 70 on the top panel 14 (shown as extensions beyond triangle-shaped portions 76, 78 in FIG. 2) are thus thinner than the triangle shaped portions 76, 78. These portions 72, 74 can also serve the purpose of helping to hold the flap 24 within the package during cooking as discussed below; however, it is understood that these portions are not required.

Figure 3:
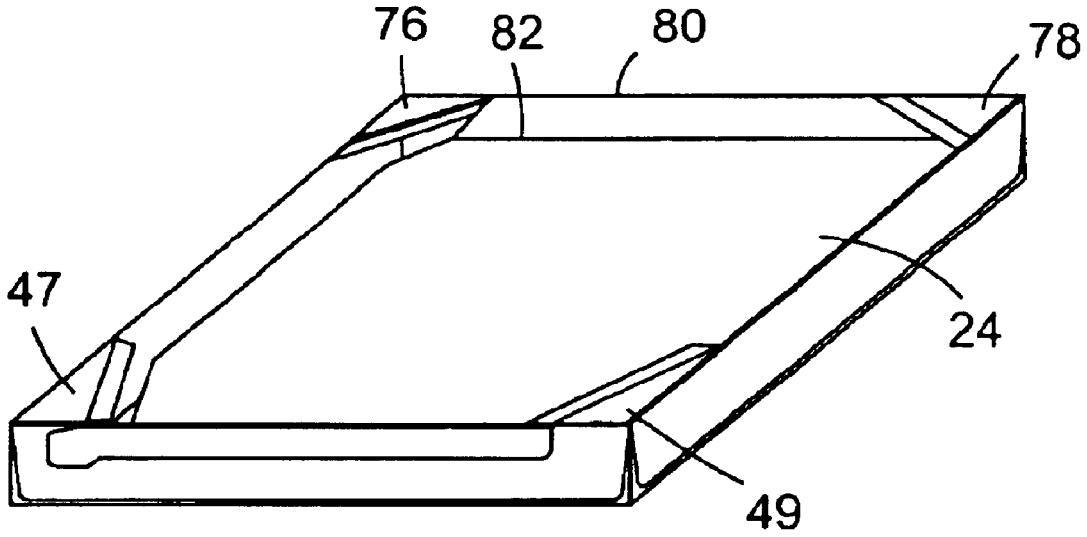
FIG. 3 is a perspective view of the packaging container of FIGS. 1 and 2 with a reconfigurable flap portion folded and partially inserted into the interior of the packaging container, and preferably in contact with at least one food product contained therein.

The flap 24 preferably further includes a fold line 82 that is spaced from and extends generally parallel to the intersection line 80 between the top panel 14 and the back panel 22. This fold line 82 provides the preferred position where the flap 24 can be folded in the opposite fold direction than that of the fold at the intersection line 80, as shown in FIG. 3. The fold line 82 is further preferably spaced from intersection line 80 by a distance that generally corresponds to the height of the food products that will be contained and cooked within a particular package. Preferably, the consumer will open the flap 24 to its fully opened position, as shown in FIG. 2 (i.e., all the way to the intersection line 80), then fold the flap 24 along the fold line 82 in the opposite fold direction as that of the fold direction of intersection line 80. The flap 24 may then be pressed downward toward the interior portion of the package 10, thereby essentially returning the package to a semi-closed position. The flap 24 can then be further pressed toward the interior of the package until the edges 46, 48 near the front of the box pass by the triangle-shaped portions 47, 49, respectively, and any portions 50, 52 that extend beyond portions 47, 49. These portions 50, 52 are preferably flexible enough to move easily downward when the flap is pressed downward, then generally return to their original position after the flap passes by them. If the flap 24 is pressed even further downward, the angled flap edges 68, 70 will also pass by the triangle-shaped portions 76, 78, respectively, and any portions 72, 74 that extend beyond portions 76, 78. This reconfiguration of the package 10 will be discussed in further detail below, in conjunction with the cooking and crisping of food products.

The package 10 preferably further comprises a microwave susceptor sheet 84 on the side of the flap 24 that faces the interior of the package. The susceptor sheet 84 may include any of a number of configurations for a sheet that includes one or more than one layers of material that are responsive to microwave radiation so that when the material comes in contact with or is placed in close proximity to a food product surface, that surface will be heated more quickly than if no susceptor were present. The microwave susceptor sheet may be a relatively thin sheet with a conductive coating, such as a metallized film, that absorbs microwave energy during exposure to microwave fields, and subsequently transfers that energy to surfaces with which it comes in contact. For example, a susceptor sheet may include a thin metal film, such as aluminum, deposited on a polyester film. This metallized layer or film may be bonded or attached to a supporting layer, such as a paper layer, to provide additional structural stability to the susceptor arrangement. However, the susceptor sheet may include any of a number of susceptor configurations, such as multiple film layers bonded or attached to a supporting layer, or configurations that do not include a supporting layer. It is further contemplated that susceptor materials or coatings may be coated or applied directly onto the surface or surfaces that require a susceptor material, in accordance with the present invention.

The embodiment of FIGS. 2 and 3 illustrates one preferred configuration of susceptor sheet 84 attached to the inside surface of the flap 24. This susceptor sheet 84 is a flexible material that is preferably selected to provide a desired level of crisping to the surface of the food products in which it comes in contact. Typically, the ability of the susceptor to provide crisping to the surface of a food is increased as the thickness of the metallic layer is increased. However, in cases where it is also desirable that the susceptor sheet be relatively flexible, the film thickness may need to be smaller so that the susceptor is not too rigid. In one preferred embodiment, the susceptor sheet 84 is a polyester film metallized with aluminum and attached to a paper layer to provide a susceptor product that is equivalent in weight to a 150-pound paper product.

In one preferred embodiment of the invention, the size and shape of the susceptor is chosen to closely match the inside dimensions of the package surface on which it is mounted or coated. This configuration can be advantageous to maximize the amount of available susceptor surface that can come in contact with a food product surface during microwave cooking. In other words, if the susceptor surface was instead relatively small as compared to the package surface, it would be more likely that portions of the food products contained within the package will be exposed to only a paper package surface rather than a susceptor surface, and will thus not receive the heating benefits that a susceptor can provide. As is best illustrated in FIG. 2, the susceptor sheet 84 is rectangular to match the general shape of the top panel 14, and is only slightly smaller than the outside dimensions of that panel. However, due to the angled edges 46, 48 near the front of the package and the angled edges 68, 70 near the back of the package, the squared corners of the susceptor sheet 84 actually extend beyond the angled edges of the flap 24, such as shown at a corner 86 that extends beyond the angled edge 48. In this arrangement, the susceptor sheet 84 should be sufficiently flexible to bend relatively easily at its corners to move past the angled edges, then flex back to its original condition (i.e., a relatively flat susceptor sheet). The susceptor sheet should also be sufficiently flexible to bend in the opposite direction to move past the angled edges when the flap 24 is pressed into the package.

Figure 4:
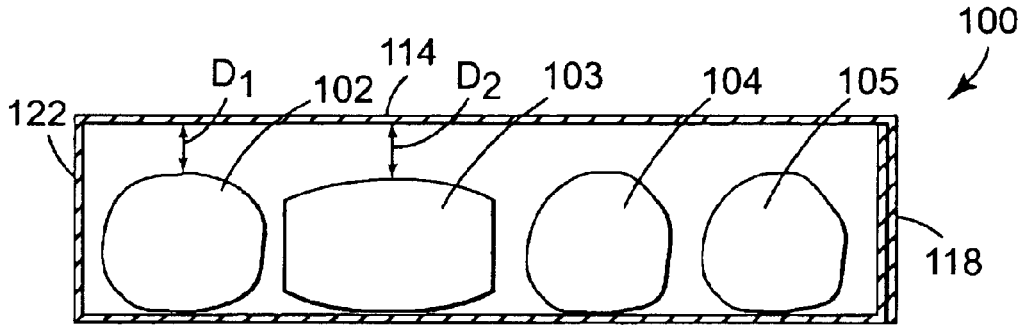
FIG. 4 is a cross-sectional view of one preferred embodiment of a packaging container of the present invention holding a plurality of food products, where the packaging container is in its sealed and shipping condition.
Figure 5:
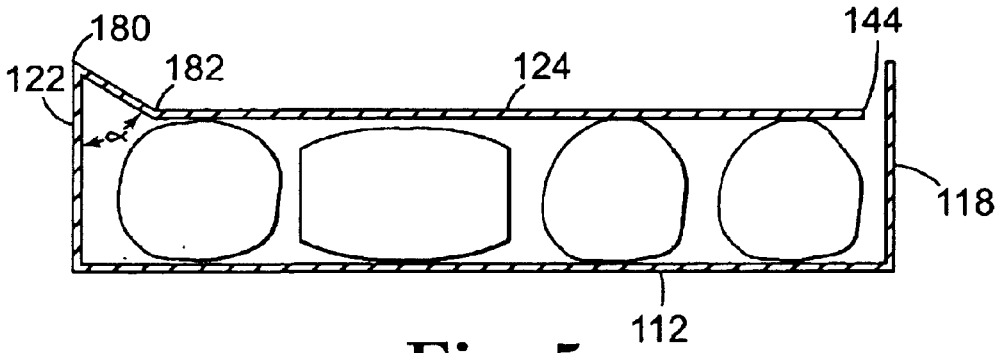
FIG. 5 is a cross-sectional view of the packaging container of FIG. 4, where this container is reconfigured for the process of heating and crisping the plurality of food products held in the package.

FIGS. 4 and 5 further illustrate a cross-sectional view of one embodiment of a package 100 for cooking and crisping the outer surface of a plurality of food products. Specifically, FIG. 4 illustrates a cross-sectional view of a closed package 100 that is similar to the package 10 described above, including four representative food products 102, 103, 104, 105 enclosed within the package. A single package could, however, include any number of the same or different products, where these products are preferably similarly sized and shaped and have the same or similar cooking and crisping requirements so that they can all be processed simultaneously during one cooking operation. These products 102–105 could be, for example, filled pizza roll products, such as those of the type commercially available from General Mills, Inc. of Minneapolis, Minn. under the trade designation "Totino's Pizza Rolls". Other food products that may be held and cooked within the container include various food snacks, appetizers, entrees or desert products, such as egg rolls, potstickers, fried dumplings, hash browns, pot pies, filled or unfilled biscuits, breadsticks, nugget or bite sized products (such as breaded nuggets containing meat or vegetables), filled and unfilled pies, pizzas (including pizza slices, mini pizzas, and larger pizzas), sandwiches, burritos, popovers, breaded or unbreaded cheese or vegetable sticks, fried chicken pieces, breaded or unbreaded vegetable products (such as cheese-filled breaded peppers), quesadilla pieces or slices, strudel cakes, various filled dough products having savory or sweet fillings, and the like. A food manufacturer will typically insert these food products into the package 100 immediately prior to closing and sealing the package for shipping, but there may be other intermediate steps between filling and sealing the package.

As shown in FIG. 4, a space is preferably provided between the food products 102–105 and top panel 114. When such a space is provided, it is preferable that it is large enough that the package can accommodate slightly oversized or misshapen food products or products that are differently oriented in the package, without the package becoming substantially deformed upon closing. In particular, the top surface of food product 102 is spaced from top panel 114 by a distance $D_1$, and because products 102, 104, and 105 have generally the same orientation and size, the distance between these products and the top panel 114 is the same or similar to this distance $D_1$. As shown, product 103 is oriented and/or sized differently than product 102, thus, the top surface of food product 103 is spaced from top panel 114 by a distance $D_2$ that is larger than the distance $D_1$. Typically, the closed package 100 with its enclosed food products will be shipped in this manner from the manufacturer to the retailer or wholesaler, then eventually to the consumer.

Although the configuration of package 100 could be identical to that described relative to package 10 above, package 100 could have any number of different variations on the package construction to allow a flap 124 with angled edges or corners to be pulled back from the top panel 114 (e.g., perforations, double-cut sections, and the like), or the entire top panel 114 may comprise the flap 124, if desired. In any case, in order to cook and crisp the products enclosed in a package 100 using the methods of the present invention, at least a portion of the top panel 114 would be pulled away from the front panel 118 and toward a back panel 122. When the package is completely opened, a flap 124 (or the entire top panel 114) will preferably only be attached to the package 100 at the fold line 180 at the intersection of the flap 124 and the back panel 122. The flap 124 would then be folded at fold line 182 in the opposite direction of the fold at line 180. The flap 124 would then be pressed downwardly toward the food products in the package 100, as shown in FIG. 5. Preferably, the flap 124 will be pressed downwardly until the inside surface of the flap 124, which preferably has a susceptor attached thereto (not shown), comes in contact with most or all of the food products contained within the package, thereby minimizing or eliminating the distances $D_1$ and $D_2$ between the products 102 and 103, respectively.

The area of flap 124 between fold line 180 and fold line 182 will be at an angle $\alpha$ relative to the back panel 122 when the flap 124 is pressed inside the package, where this angle can vary depending on the relative shape and size of the food products and packaging components. For example, flap 124 would be spaced further from a bottom panel 112 if that box contains larger food products and will therefore result in an angle $\alpha$ that is typically larger than the angle $\alpha$ that would result if the package contained smaller food items. In other words, the further the distance that the flap 124 must be pressed into the package 100 to contact the food products contained therein, the tighter or smaller the angle $\alpha$ will be.

It is also preferable that the flap 124 is pressed downwardly into the package 100 until the portion of flap 124 between fold line 182 and a front edge 144 of the flap 124 is generally parallel to the bottom panel 112. In most cases, this configuration will allow the susceptor inside the flap 124 to come in more uniform contact with each of the similarly sized and shaped food products inside the container since it will be generally horizontal and resting on top of multiple food products. In other words, without the fold line 182, the flap 124 would basically be hinged only at the fold line 180 and thus would be angled at a generally constant slope from the fold line to the front edge 144 (as opposed to horizontally oriented, as in the present invention), and would likely only contact the food products near the front of the box at the point where the flap 124 first contacts a food product.

Another advantage to the packaging configuration of the present invention is that when the flap 124 is pressed into the interior portion of the package 100, as shown in FIG. 5, the front edge 144 will be spaced at least slightly from the front panel 118, thereby providing a space for excess moisture or steam to escape the package during microwave cooking. Moisture can also escape the package along the side edges of the flap 124. In the preferred arrangement of the flap when inserted into the package, when the angle $\alpha$ at which the flap portion between fold lines 180 and 182 is relatively small, the space between the front edge 144 and the front panel 118 will be relatively large. Conversely, when the angle $\alpha$ is relatively large, the front edge 144 of flap 124 will not be moved as far toward the back panel 122, thus, the space between the front edge 144 and the front panel 118 will be relatively small. The size of this gap between edge 144 and panel 114 can be selected or adjusted by designing packaging for certain food sized products that will require more or less reconfiguration of the flap depending on the amount of steam that is anticipated to escape from a particular product during microwaving.

It is further noted that when a package is configured similar to the package 10 of FIGS. 1 through 3, a flap portion can further be restrained from moving upwardly (i.e., outside the interior portion of the package) by the portions 50, 52 that extend beyond the triangle-shaped portions 47, 49 and/or by the portions 72, 74 that extend beyond the triangle-shaped portions 76, 78. That is, when the flap 24 is pressed into the interior portion of the package, any of the angled edges 46, 48, 68, and 70 that interfere with a corresponding portion 50, 52, 72, or 74 are pushed past that corresponding portion (which is flexible due to its reduced thickness from the double-cutting process). Because these portions would not typically be permanently bent or folded by this process, they would move back generally to their original position. In addition, if any susceptor material, such as the susceptor sheet 84, extends beyond any angled edges of the flap 24, these portions that extend beyond the angled edges will also preferably flexibly deform when the flap is pushed into the package, then flex back to their original configuration, thereby also helping to keep the flap within the package during cooking.

Figure 6:
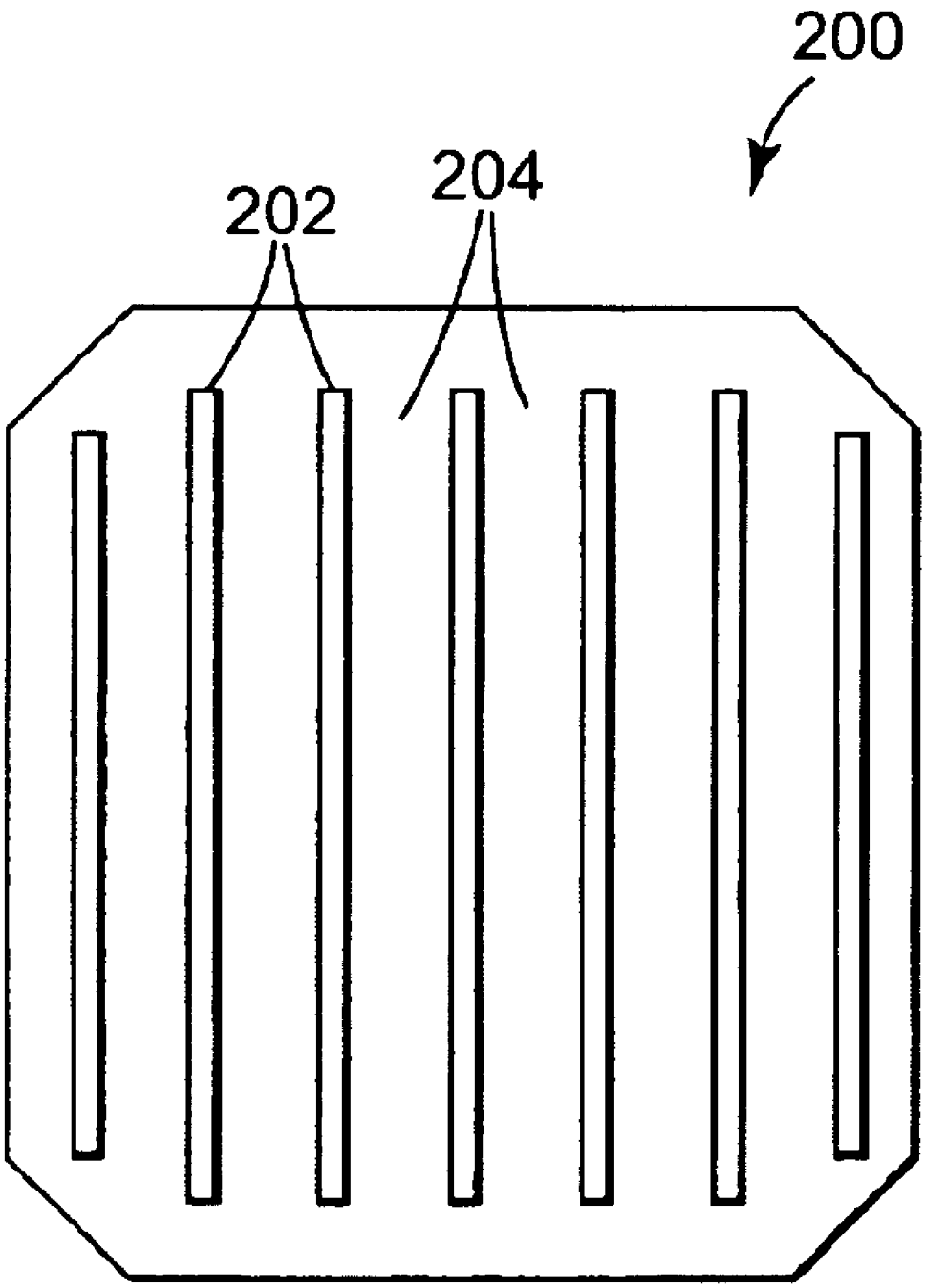
FIG. 6 is a top plan view of one embodiment of a flap portion of a packaging container in accordance with the invention, including a pattern of adhesive stripes for attachment of a susceptor sheet thereto.

FIG. 6 illustrates one preferred embodiment of the interior side or face of a flap 200 of a package in accordance with the present invention, including a pattern of multiple adhesive strips 202 for attachment of a microwave susceptor sheet thereto. This side of the flap 200 is the side that faces the interior portion of the package when the package is assembled. As shown, the adhesive strips 202 are spaced from each other across the width of flap 200, with a space or channel 204 between each adjacent pair of strips 202. The number of strips 202 and their spacing from each other can vary considerably, depending on many factors, such as the dimensions and thicknesses of the flap and susceptor materials and surfaces, the materials from which the flap and susceptor are made, the strength of the adhesive, and many other variables. In any case, the arrangement and number of strips is preferably sufficient to adequately secure a susceptor sheet to the flap surface throughout the assembly, shipping, and cooking operations, without allowing detachment of the sheet from the flap before or during the cooking process.

Regarding the particular orientation, positioning, and length of adhesive strips 202, many variations are possible and considered to be within the scope of the present invention. It is generally preferable that the channels 204 between adjacent strips provide a path for any moisture between the susceptor sheet and the flap to escape from between these surfaces and to the surrounding atmosphere. This moisture is often present due to residual moisture in the adhesive that is released when the adhesive reaches a certain temperature during the heating process, but may also be excess moisture from the food products, shipping conditions, or other factors. Another contributor to the excess moisture may be the paper or carton stock that makes up the package. In any case, because the channels are designed to provide an open path for the moisture to escape from between the susceptor sheet and the package surface to which it is attached, these channels help to prevent or minimize bubbling or blistering of the susceptor sheet that could occur if the moisture was trapped between those surfaces during the microwave heating process. Such bubbling or blistering is typically undesirable because it can cause deformation of the flap surface, which may then result in less contact between the susceptor and food product surfaces. This would, in turn, make the susceptor less effective for crisping the surface of food products.

It is further desirable that the length of the adhesive strips 202 and their spacing from the edges of the susceptor sheet that will be attached thereto are positioned to keep the susceptor sheet relatively flat and secured to the surface of the flap, while allowing sufficient release of moisture. However, it is also desirable to minimize the amount of adhesive that is used to achieve these functions, since excess adhesive can add unnecessary moisture to the package and makes the package more expensive to manufacture.

While the adhesive strips 202 are shown as linear and parallel to each other, it is understood that the strips 202 may instead be angled regularly or irregularly relative to each other, and that the strips may instead be wavy or otherwise nonlinear and/or irregular along their lengths. In this case, it is also preferable that channels are provided between adjacent strips to allow moisture to escape from between the susceptor sheet and the flap surface. Various adhesives and adhesive types may be used for the adhesive strips 202 including, for example, hot melt adhesives, solvent-based adhesives, and heat-activated adhesives. In one preferred embodiment, each adhesive strip is approximately ⅛ inch (0.32 cm) wide, 0.1 inch (0.25 cm) thick, and spaced from each adjacent adhesive strip by approximately ½ inch (1.27 cm). As explained above, however, many variations of the particular orientation, positioning, spacing, width, and length of adhesive strips 202, are possible and considered to be within the scope of the present invention Referring again to FIGS. 1 through 3, the package 10 may further comprise at least one additional microwave susceptor sheet that is positioned on the inside of the package on a surface that is opposite the susceptor sheet 84. More specifically, a second susceptor sheet 90 is positioned adjacent to the side of the bottom panel 12 that faces the interior of the package, which can provide crisping to the surfaces of the food products that rest on the bottom panel 12 during microwave cooking. In this embodiment, food products contained within the package 10 will thus have their oppositely facing surfaces in contact with susceptors to provide crisping on opposite sides of the food product when the package is reconfigured as described above. The susceptor sheets 84, 90 of a particular package may be identical in size, shape, thickness, and the like, or the sheets 84, 90 may be selected to have different properties to provide different cooking and crisping functions to the top and bottom surfaces of food products, as desired.

As with the susceptor sheet 84, the sheet 90 may include a number of different configurations and materials suitable in a package for microwave cooking and crisping of food products. In one preferred embodiment, the susceptor sheet 90 is attached to the bottom panel 12 in the same or similar manner to the attachment technique used for the susceptor sheet 84. That is, sheet 90 may also be attached to bottom panel 12 with a series of adhesive strips spaced from each other, including a channel between each adjacent pair of adhesive strips. The arrangement and number of these adhesive strips is preferably sufficient to adequately secure the susceptor sheet 90 to the bottom panel 12 throughout the assembly, shipping, and cooking operations, while minimizing release or significant bubbling of the sheet during the cooking process.

It is also preferable that the size and shape of the susceptor sheet 90 is chosen to closely match the dimensions of the bottom panel 12 on which it is mounted or coated in order to maximize the amount of surface area of food products that can contact a susceptor surface. It is also contemplated that the susceptor sheet is not a separate component adhered to an interior surface of the package, but that the susceptor is instead a coating layer or material that is applied directly onto the bottom panel.

A particular package may further include microwave susceptor materials on package surfaces other than the inside of the top and bottom panels. For example, some or all of the side panels may also include susceptor materials to provide crisping to additional surfaces of the food products.

In another preferred embodiment of the present invention, a package may be provided with one or more susceptor sheets as separate components that are not attached to any interior package surfaces. In this arrangement, the package is provided with at least one susceptor sheet that can be positioned within the package as an insert that is placed by the consumer on either on top, below, or both on top and below the food products contained in the package before microwave cooking of the products. If a susceptor sheet is to be placed on top of the food products to facilitate crisping, the other features of the package described above may still be utilized to keep the susceptor sheet from moving within the package. Specifically, it is still advantageous for the package flap to include a fold line so that the top panel can be reconfigured as described above.

Figure 7:
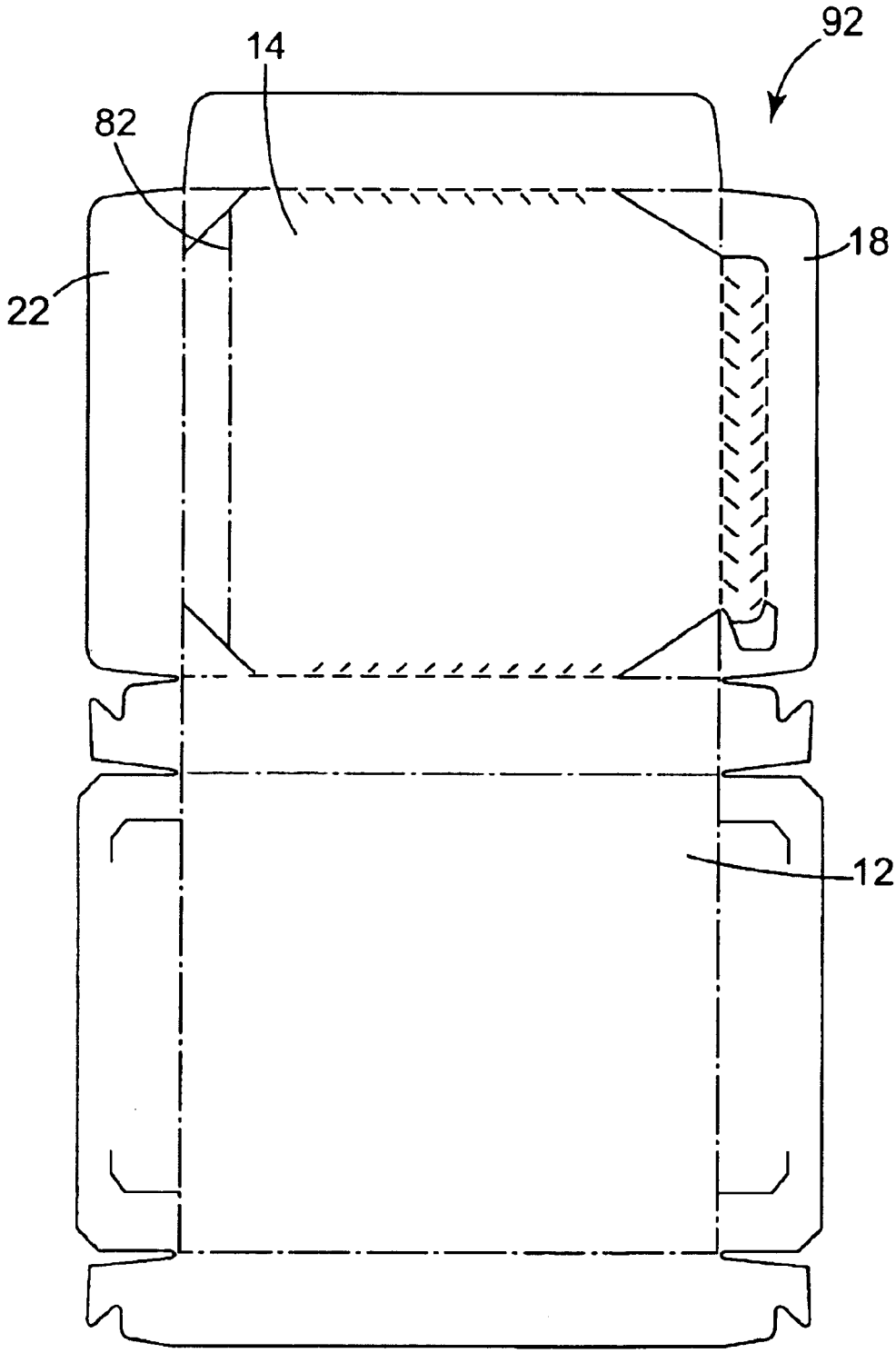
FIG. 7 is a top plan view of a one-piece package blank that can be folded and sealed to form a packaging container for holding at least one food product, wherein the package blank may have at least one sheet of susceptor material attached thereto before the package is folded to hold food products.

The package of the present invention may be constructed of several pieces that are secured to each other, such as with adhesives, during package forming and assembly. Alternatively, one preferred construction of the package 10 of the present invention is provided as a one-piece package blank 92, illustrated in FIG. 7, that is folded, secured, and adhered, as appropriate, into a package of the type shown in FIG. 1. The blank 92 comprises several panels, such as bottom panel 12, top panel 14, front panel 18, and back panel 22, for example, that are described above relative to the description of package 10. One arrangement of various fold lines, lines of weakening, score lines, and perforations are also illustrated, where the package would be formed by conventional package forming methods during the manufacturing and assembly process to provide a package that can receive a plurality of food products for cooking and crisping. If one or more susceptor sheets are to be included in a particular package, it would typically be advantageous for ease of manufacturing to attach or coat such susceptor sheets or material directly onto the flat blank 92 before folding it into the desired package configuration.

One method of assembling a package of the type described above includes the processes of making a one-piece package blank such as blank 92, attaching or coating one or more susceptor sheets to the blank, and forming the package by folding the blank where appropriate, inserting tabs into appropriate slots, and adhering package flaps where appropriate so that the package is structurally stable enough to receive food products. The package would then be filled with appropriate food products and sealed so that no contaminants can enter the package. At this point, the food package can be shipped to the customer, typically in cartons or crates that can accommodate large numbers of individual food packages.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

What is claimed is:

1. A reconfigurable microwave packaging container for containing, heating, and crisping at least one surface of at least one food product, the container comprising:

a reconfigurable first panel comprising a flap that is at least partially separable from the container, at least a portion of the flap comprising a microwave susceptor material for absorbing microwave energy to transfer to at least one food product surface; and a second panel spaced from the first panel by a first distance to accommodate at least one food product between the first and second panels;

wherein at least a portion of an edge of the flap of the first panel is adjacent to a front container panel when the first panel is spaced at the first distance from the second panel and wherein the flap is reconfigurable to be spaced at a second distance from the second panel, wherein the second distance is smaller than the first distance.

2. The container of claim 1, wherein the flap includes at least one fold line to facilitate the reconfiguration of the flap.

3. The container of claim 2, wherein the reconfiguration of the flap includes folding the flap along the fold line, thereby defining a first flap portion and a second flap portion.

4. The container of claim 3, wherein one of the first and second flap portions is generally parallel to the second panel of the container when the flap portion is reconfigured.

5. The container of claim 3, wherein at least one of the first and second flap portions is reconfigurable to contact an outside surface of at least one food product.

6. The container of claim 3, the flap further comprising a front edge that is positioned at an intersection line between the first panel and a front container panel when the flap is spaced at the first distance from the second panel, wherein the front edge of the flap is spaced from the front container panel by a gap distance when the flap is spaced at the second distance from the second panel.

7. The container of claim 6, wherein the gap distance is sufficiently large to allow steam to escape from the container during the microwave cooking process.

8. The container of claim 1, wherein at least a portion of the second panel includes a microwave susceptor material.

9. The container of claim 1, wherein the microwave susceptor material comprises a microwave susceptor sheet.

10. The container of claim 9, wherein the susceptor sheet is attached to the first panel by a plurality of adhesive strips spaced from each other to provide a channel having opposite ends between each adjacent pair of adhesive strips, wherein at least one of the ends of each channel includes an opening to allow moisture to escape.

11. The container of claim 10, wherein each of the plurality of adhesive strips is generally parallel to each adjacent adhesive strip.

12. The container of claim 10, wherein each of the plurality of adhesive strips is generally linear.

13. The container of claim 1, wherein the microwave susceptor material comprises a coated microwave susceptor layer.

14. The container of claim 1, further comprising at least one food piece having a food height, wherein the food height of each of the at least one food pieces is less than the first distance between the first and second panels.

15. The container of claim 1, further comprising at least one food piece having a food height, wherein the food height of at least one of the food pieces is equal to the second distance between the second panel and the flap of the first panel.

16. The container of claim 1, wherein the container is formed from a single piece package blank, wherein the blank comprises the microwave susceptor material positioned on the first panel.

17. The container of claim 1 in combination with at least one food product, wherein the at least one food product is a filled dough product.

18. The container of claim 17, wherein the filled dough product is a pizza roll.

19. The container of claim 1 in combination with at least one food product that is microwavable to achieve an outer food product surface that is crisper than an interior portion of the food product.

20. A reconfigurable microwave packaging container for containing, heating and crisping at least one surface of at least one food product, the container comprising:

a reconfigurable first panel comprising a flap that is at least partially separable from the container, wherein the flap comprises at least one fold line;

a second panel spaced from the first panel by a first distance to accommodate at least one food product between the first and second panels; and at least one microwave susceptor sheet;

wherein at least a portion of an edge of the flap of the first panel is adjacent to a front container panel when the first panel is spaced at the first distance from the second panel and wherein the flap is reconfigurable by folding at the fold line to space the flap at a second distance from the second panel, wherein the second distance is smaller than the first distance.

21. The container of claim 20, wherein a first microwave susceptor sheet is positioned within the container to contact a first surface of at least one food product.

22. The container of claim 21, wherein a second microwave susceptor sheet is positioned within the container to contact a second surface of at least one food product.

23. A method of containing, heating, and crisping at least one food product comprising the steps of:

providing a reconfigurable container in a first position, the container comprising a first panel, a second panel spaced from the first panel, and at least one food product positioned between the first and second panels, the first panel comprising a microwave susceptor material and a flap having a fold line, wherein an edge of the flap is adjacent to a front container panel;

partially separating the flap from the container;

folding the flap along the fold line;

pressing the flap from the first position toward the second panel of the container until the microwave susceptor material of the flap contacts the at least one food product within the container; and applying microwave energy to the container so that the food products are heated by a predetermined amount.

24. The method of claim 23, further comprising the step of pulling the flap away from the food products after the application of microwave energy so that the food products can be removed for consumption.

25. The method of claim 23, wherein the at least one food product is a filled dough product.

26. The method of claim 23, wherein the at least one food product is microwavable to achieve an outer food product surface that is crisper than an interior portion of the food product.

27. A reconfigurable microwave packaging container for containing, heating, and crisping at least one surface of at least one food product, the container comprising:

a reconfigurable first panel comprising a flap that is at least partially separable from the container, at least a portion of the flap comprising a microwave susceptor material for absorbing microwave energy to transfer to at least one food product surface; and a second panel spaced from the first panel by a first distance to accommodate at least one food product between the first and second panels wherein a front edge of the flap of the first panel is positioned is at an intersection line between the first panel and a front container panel when the flap is spaced at the first distance from the second panel;

wherein the flap of the first panel is reconfigurable to be spaced at a second distance from the second panel by folding the flap along at least one fold line thereby defining a first flap portion and a second flap portion wherein the second distance is smaller than the first distance and the front edge of the flap is spaced from the front container panel by a gap distance when the flap is spaced at the second distance from the second panel.

28. A reconfigurable microwave packaging container for containing, heating, and crisping at least one surface of at least one food product, the container comprising:

a reconfigurable first panel comprising a flap that is at least partially separable from the container, at least a portion of the flap comprising a microwave susceptor material for absorbing microwave energy to transfer to at least one food product surface, the microwave susceptor material comprising a microwave susceptor sheet attached to the first panel by a plurality of adhesive strips spaced from each other to provide a channel having opposite ends between each adjacent pair of adhesive strips, at least one of the ends of each channel including an opening to allow moisture to escape; and a second panel spaced from the first panel by a first distance to accommodate at least one food product between the first and second panels;

wherein the flap of the first panel is reconfigurable to be spaced at a second distance from the second panel the second distance smaller than the first distance.

* * * * *

UNITED STATES PATENT AND TRADEMARK OFFICE

CERTIFICATE OF CORRECTION

PATENT NO. : 6,781,101 B1
DATED : August 24, 2004
INVENTOR(S) : Thomas C. Hoese et al.

It is certified that error appears in the above-identified patent and that said Letters Patent is hereby corrected as shown below:

Title page,
Item [73], Assignee, replace with -- The Pillsbury Company
Minneapolis, Minnesota --

Signed and Sealed this

Fifteenth Day of March, 2005

JON W. DUDAS
*Director of the United States Patent and Trademark Office*